US011598152B2

(12) United States Patent
Ghimire et al.

(10) Patent No.: US 11,598,152 B2
(45) Date of Patent: Mar. 7, 2023

(54) REAL-TIME FAULT DIAGNOSTICS AND DECISION SUPPORT SYSTEM FOR ROTARY STEERABLE SYSTEM

(71) Applicant: Halliburton Energy Services, Inc., Houston, TX (US)

(72) Inventors: Rajeev Ghimire, Spring, TX (US); Reena Agarwal Chanpura, Sugarland, TX (US); Narasimha Rao Gummaraju, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/880,078

(22) Filed: May 21, 2020

(65) Prior Publication Data

US 2021/0363829 A1 Nov. 25, 2021

(51) Int. Cl.

| | |
|---|---|
| ***E21B 7/06*** | (2006.01) |
| ***E21B 44/00*** | (2006.01) |
| ***E21B 47/09*** | (2012.01) |
| ***E21B 47/12*** | (2012.01) |

(52) U.S. Cl.

CPC ..... *E21B 7/06* (2013.01); *E21B 44/00* (2013.01); *E21B 47/09* (2013.01); *E21B 47/12* (2013.01); *E21B 2200/22* (2020.05)

(58) Field of Classification Search

CPC ... E21B 7/06; E21B 7/04; E21B 44/00; E21B 47/09; E21B 47/12; E21B 2200/22

See application file for complete search history.

(56) References Cited

U.S. PATENT DOCUMENTS

| | | | |
|---|---|---|---|
| 2004/0183408 | A1 | 9/2004 | Levy et al. |
| 2004/0256152 | A1 | 12/2004 | Dashevskiy et al. |
| 2006/0095142 | A9 | 5/2006 | Evans et al. |
| 2010/0161227 | A1 * | 6/2010 | Deere ..... E21B 47/26 702/9 |
| 2012/0118637 | A1 | 5/2012 | Wang et al. |
| 2015/0300151 | A1 | 10/2015 | Mohaghegh |
| 2016/0177699 | A1 | 6/2016 | Benson et al. |

(Continued)

FOREIGN PATENT DOCUMENTS

WO 2010-019798 2/2010

OTHER PUBLICATIONS

Written Opinion for Application No. PCT/US2020/035293, dated Feb. 16, 2021.

(Continued)

*Primary Examiner* — Dany E Akakpo

(74) *Attorney, Agent, or Firm* — Benjamin Ford; C. Tumey Law Group PLLC

(57) ABSTRACT

A method and system for a rotary steerable system (RSS). The method may comprise disposing the RSS into a borehole, identifying a failure from the one or more tracking measurements, the mechanical operation of the RSS, or the one or more sensors from a diagnostic review. Additionally, the method may further comprise flagging the failure with a failure code and reporting the failure and its mitigation actions to personnel in real time. The system may comprise one or more sensors configured to measure a location the RSS in a formation from one or more tracking measurements and monitor a mechanical operation of the RSS. The system may further comprise an information handling system.

18 Claims, 3 Drawing Sheets

(56) References Cited

U.S. PATENT DOCUMENTS

| | | | | |
|---|---|---|---|---|
| 2018/0179880 | A1 | 6/2018 | Sankaran et al. | |
| 2019/0338628 | A1* | 11/2019 | Sehsah | E21B 7/04 |
| 2021/0040834 | A1* | 2/2021 | Valleru | G08B 27/00 |

OTHER PUBLICATIONS

International Search Report and Written Opinion for Application No. PCT/US2020/035293, dated Feb. 16, 2021.

* cited by examiner

REAL-TIME FAULT DIAGNOSTICS AND DECISION SUPPORT SYSTEM FOR ROTARY STEERABLE SYSTEM

BACKGROUND

In order to obtain hydrocarbons such as oil and gas, boreholes are drilled through hydrocarbon-bearing subsurface formations. During drilling operations, directionally drilling operations may by performed where the drilling direction may veer of an intended drilling path at an angle or even horizontally away from the drilling path. Directional drilling of a subterranean well and, in particular, controlling the angle and direction of drilling through selectable bending of a shaft is controlled by a steering sub connected to the drill bit. Due to the extreme environment experienced by directional drilling equipment, failure of machinery during drilling operations may be possible.

Currently, if a failure appears within the machinery, or the drilling path is outside of a pre-designated path, personnel may be notified of the failure. However, current technology only identifies that there is a failure. Interpretation of the failure depends heavily on driller's knowledge of field operations, drilling tools and data interpretation. The driller has to evaluate surface data, key performance indices for the service, and pulsed up real-time data from downhole tools to make quick and accurate decisions at the rig.

BRIEF DESCRIPTION OF THE DRAWINGS

These drawings illustrate certain aspects of some examples of the present disclosure and should not be used to limit or define the disclosure.

DETAILED DESCRIPTION

Described below are methods and systems for real-time health assessment of a rotary steerable system ("RSS"). The proposed systems and methods include an intelligent and interactive real-time fault diagnosis and decision support system for rotary steerable system. Specifically, tests are implemented in the RSS and at the surface to detect the failure of machinery or its performance in downhole operations, or the movement of the RSS outside of the drilling path. Test failures are reported to the health assessment module. However, a single failure the failure code does not provide information on what component/model or function has failed. As discussed below, methods and system may present a fault identification to a tailored isolation level. The tailored isolation level may be at component, module or function depending on isolation requirements, isolation capability and operations requirement. Such diagnostic results may be presented with interactive health advisory, information and sequence of action items for personnel to choose from and follow. Additionally, methods and systems may automatically address the results to alter drilling operations or the RSS to address the fault. This may allow for post run diagnostics in RSS failure symptoms and aid in RSS repair or preventive maintenance.

Figure 1:
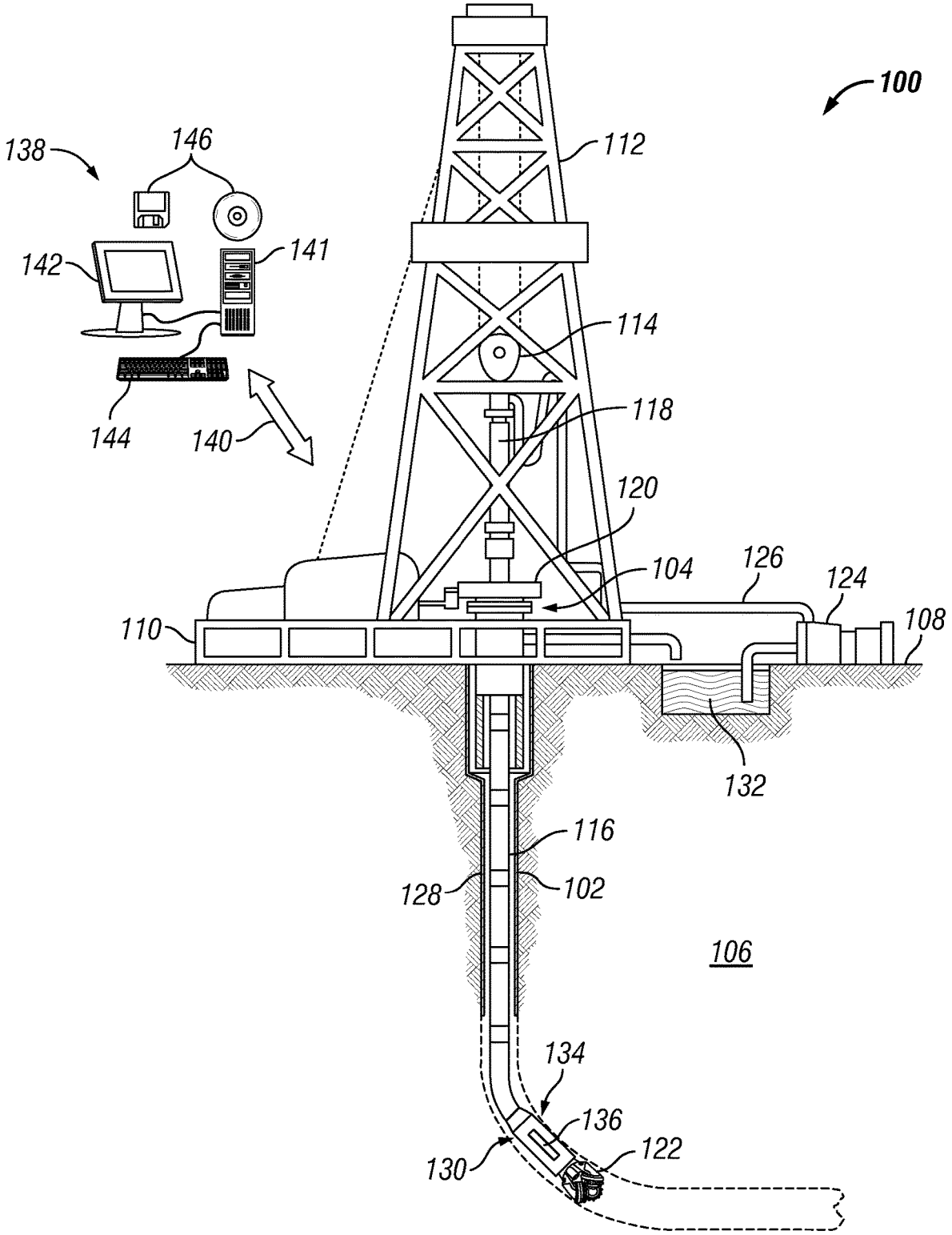
FIG. 1 illustrate an example of a drilling system.

FIG. 1 illustrates a drilling system 100 in accordance with example embodiments. As illustrated, borehole 102 may extend from a wellhead 104 into a subterranean formation 106 from a surface 108. Generally, borehole 102 may include horizontal, vertical, slanted, curved, and other types of borehole geometries and orientations. Borehole 102 may be cased or uncased. In examples, borehole 102 may include a metallic member. By way of example, the metallic member may be a casing, liner, tubing, or other elongated steel tubular disposed in borehole 102.

As illustrated, borehole 102 may extend through subterranean formation 106. As illustrated in FIG. 1, borehole 102 may extend generally vertically into the subterranean formation 106, however borehole 102 may extend at an angle through subterranean formation 106, such as horizontal and slanted boreholes. For example, although FIG. 1 illustrates a vertical or low inclination angle well, high inclination angle or horizontal placement of the well and equipment may be possible. It should further be noted that while FIG. 1 generally depict land-based operations, those skilled in the art may recognize that the principles described herein are equally applicable to subsea operations that employ floating or sea-based platforms and rigs, without departing from the scope of the disclosure.

As illustrated, a drilling platform 110 may support a derrick 112 having a traveling block 114 for raising and lowering drill string 116. Drill string 116 may include, but is not limited to, drill pipe and coiled tubing, as generally known to those skilled in the art. A kelly 118 may support drill string 116 as it may be lowered through a rotary table 120. A drill bit 122 may be attached to the distal end of drill string 116 and may be driven either by a downhole motor and/or via rotation of drill string 116 from surface 108. Without limitation, drill bit 122 may include, roller cone bits, PDC bits, natural diamond bits, any hole openers, reamers, coring bits, and the like. As drill bit 122 rotates, it may create and extend borehole 102 that penetrates various subterranean formations 106. A pump 124 may circulate drilling fluid through a feed pipe 126 through kelly 118, downhole through interior of drill string 116, through orifices in drill bit 122, back to surface 108 via annulus 128 surrounding drill string 116, and into a retention pit 132.

With continued reference to FIG. 1, drill string 116 may begin at wellhead 104 and may traverse borehole 102. Drill bit 122 may be attached to a distal end of drill string 116 and may be driven, for example, either by a downhole motor and/or via rotation of drill string 116 from surface 108. Drill bit 122 may be a part of a rotary steerable tool (RSS) 130 at distal end of drill string 116. RSS 130 may further include tools for real-time health assessment of a rotary steerable tool during drilling operations. As will be appreciated by those of ordinary skill in the art, RSS 130 may be a measurement-while drilling (MWD) or logging-while-drilling (LWD) system.

RSS 130 may comprise any number of tools, such as sensors, transmitters, and/or receivers to perform downhole measurement operations or to perform real-time health assessment of a rotary steerable tool during drilling operations. For example, as illustrated in FIG. 1, RSS 130 may include a bottom hole assembly (BHA) 134. It should be noted that BHA 134 may make up at least a part of RSS 130. Without limitation, any number of different measurement assemblies, communication assemblies, battery assemblies, and/or the like may form RSS 130 with BHA 134. Additionally, BHA 134 may form RSS 130 itself. In examples, BHA 134 may comprise one or more sensors 136. Sensors 136 may be connected to information handling system 138, discussed below, which may further control the operation of sensors 136. Sensors 136 may include (accelerometers, magnetometers, temperature sensors, speed, position sensors, etc.). During operations, sensors 136 may process real time data originating from various sources such as diagnostics data, sensor measurements, operational data, survey measurements, sensory state, drilling system 100 state, BHA 134 state, RSS 130 state, and/or the like. Information and/or measurements may be processed further by information handling system 138 to determine real time heal assessment of rotary steerable tool.

Without limitation, RSS 130 may be connected to and/or controlled by information handling system 138, which may be disposed on surface 108. Without limitation, information handling system 138 may be disposed downhole in RSS 130. Processing of information recorded may occur downhole and/or on surface 108. Processing occurring downhole may be transmitted to surface 108 to be recorded, observed, and/or further analyzed. Additionally, information recorded on information handling system 138 that may be disposed downhole may be stored until RSS 130 may be brought to surface 108. In examples, information handling system 138 may communicate with RSS 130 through a communication line (not illustrated) disposed in (or on) drill string 116. In examples, wireless communication may be used to transmit information back and forth between information handling system 138 and RSS 130. Information handling system 138 may transmit information to RSS 130 and may receive as well as process information recorded by RSS 130. In examples, a downhole information handling system (not illustrated) may include, without limitation, a microprocessor or other suitable circuitry, for estimating, receiving and processing signals from RSS 130. Downhole information handling system (not illustrated) may further include additional components, such as memory, input/output devices, interfaces, and the like. In examples, while not illustrated, RSS 130 may include one or more additional components, such as analog-to-digital converter, filter and amplifier, among others, that may be used to process the measurements of RSS 130 before they may be transmitted to surface 108. Alternatively, raw measurements from RSS 130 may be transmitted to surface 108.

Any suitable technique may be used for transmitting signals from RSS 130 to surface 108, including, but not limited to, wired pipe telemetry, mud-pulse telemetry, acoustic telemetry, and electromagnetic telemetry. While not illustrated, RSS 130 may include a telemetry subassembly that may transmit telemetry data to surface 108. At surface 108, pressure transducers (not shown) may convert the pressure signal into electrical signals for a digitizer (not illustrated). The digitizer may supply a digital form of the telemetry signals to information handling system 138 via a communication link 140, which may be a wired or wireless link. The telemetry data may be analyzed and processed by information handling system 138.

As illustrated, communication link 140 (which may be wired or wireless, for example) may be provided that may transmit data from RSS 130 to an information handling system 138 at surface 108. Information handling system 138 may include a personal computer 141, a video display 142, a keyboard 144 (i.e., other input devices.), and/or non-transitory computer-readable media 146 (e.g., optical disks, magnetic disks) that can store code representative of the methods described herein. In addition to, or in place of processing at surface 108, processing may occur downhole as information handling system 138 may be disposed on RSS 130. Likewise, information handling system 138 may process measurements taken by one or more sensors 136 automatically or send information from sensors 136 to the surface. As discussed above, the software, algorithms, and modeling is performed by information handling system 138. Information handling system 138 may perform steps, run software, perform calculations, and/or the like automatically, through automation (such as through artificial intelligence ("AI"), dynamically, in real-time, and/or substantially in real-time.

Figure 2:
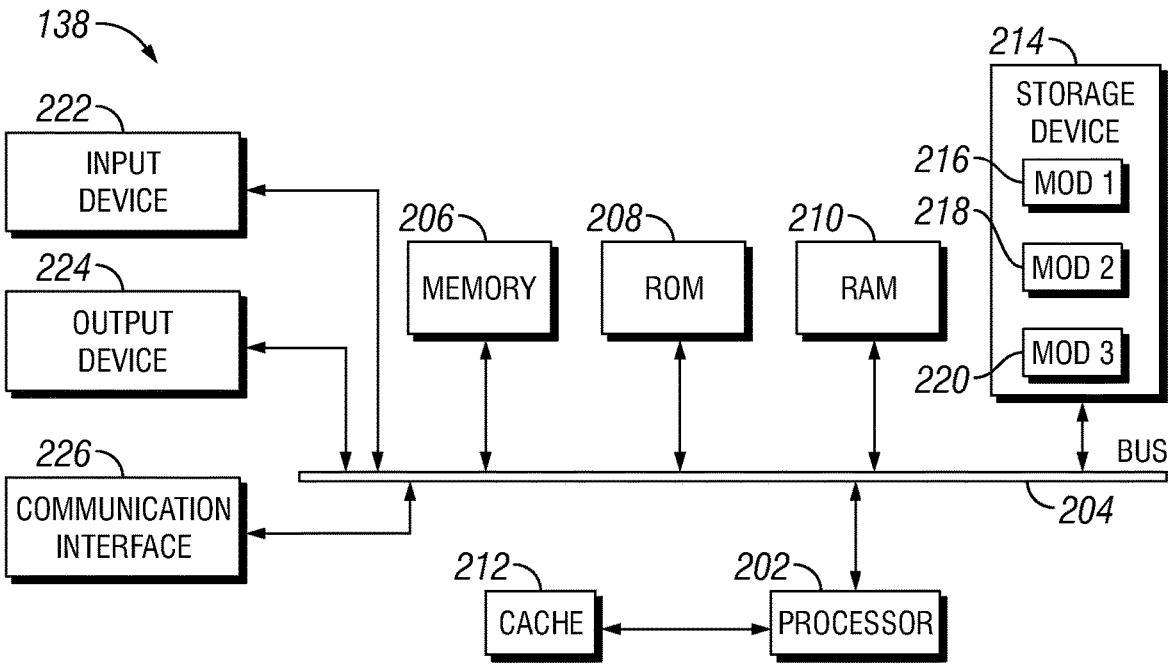
FIG. 2 is a schematic view of an information handling system.

FIG. 2 illustrates an example information handling system 138 which may be employed to perform various steps, methods, and techniques disclosed herein. Persons of ordinary skill in the art will readily appreciate that other system examples are possible. As illustrated, information handling system 138 includes a processing unit (CPU or processor) 202 and a system bus 204 that couples various system components including system memory 206 such as read only memory (ROM) 208 and random access memory (RAM) 210 to processor 202. Processors disclosed herein may all be forms of this processor 202. Information handling system 138 may include a cache 212 of high-speed memory connected directly with, in close proximity to, or integrated as part of processor 202. Information handling system 138 copies data from memory 206 and/or storage device 214 to cache 212 for quick access by processor 202. In this way, cache 212 provides a performance boost that avoids processor 202 delays while waiting for data. These and other modules may control or be configured to control processor 202 to perform various operations or actions. Other system memory 206 may be available for use as well. Memory 206 may include multiple different types of memory with different performance characteristics. It may be appreciated that the disclosure may operate on information handling system 138 with more than one processor 202 or on a group or cluster of computing devices networked together to provide greater processing capability. Processor 202 may include any general purpose processor and a hardware module or software module, such as first module 216, second module 218, and third module 220 stored in storage device 214, configured to control processor 202 as well as a special-purpose processor where software instructions are incorporated into processor 202. Processor 202 may be a self-contained computing system, containing multiple cores or processors, a bus, memory controller, cache, etc. A multi-core processor may be symmetric or asymmetric. Processor 202 may include multiple processors, such as a system having multiple, physically separate processors in different sockets, or a system having multiple processor cores on a single physical chip. Similarly, processor 202 may include multiple distributed processors located in multiple separate computing devices, but working together such as via a communications network. Multiple processors or processor cores may share resources such as memory 206 or cache 212, or may operate using independent resources. Processor 202 may include one or more state machines, an application specific integrated circuit (ASIC), or a programmable gate array (PGA) including a field PGA (FPGA).

Each individual component discussed above may be coupled to system bus 204, which may connect each and every individual component to each other. System bus 204 may be any of several types of bus structures including a memory bus or memory controller, a peripheral bus, and a local bus using any of a variety of bus architectures. A basic input/output (BIOS) stored in ROM 208 or the like, may provide the basic routine that helps to transfer information between elements within information handling system 138, such as during start-up. Information handling system 138 further includes storage devices 214 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 214 may include software modules 216, 218, and 220 for controlling processor 202. Information handling system 138 may include other hardware or software modules. Storage device 214 is connected to the system bus 204 by a drive interface. The drives and the associated computer-readable storage devices provide nonvolatile storage of computer-readable instructions, data structures, program modules and other data for information handling system 138. In one aspect, a hardware module that performs a particular function includes the software component stored in a tangible computer-readable storage device in connection with the necessary hardware components, such as processor 202, system bus 204, and so forth, to carry out a particular function. In another aspect, the system may use a processor and computer-readable storage device to store instructions which, when executed by the processor, cause the processor to perform operations, a method or other specific actions. The basic components and appropriate variations may be modified depending on the type of device, such as whether information handling system 138 is a small, handheld computing device, a desktop computer, or a computer server. When processor 202 executes instructions to perform "operations", processor 202 may perform the operations directly and/or facilitate, direct, or cooperate with another device or component to perform the operations.

As illustrated, information handling system 138 employs storage device 214, which may be a hard disk or other types of computer-readable storage devices which may store data that are accessible by a computer, such as magnetic cassettes, flash memory cards, digital versatile disks (DVDs), cartridges, random access memories (RAMs) 210, read only memory (ROM) 208, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with information handling system 138, an input device 222 represents any number of input mechanisms, such as a microphone for speech, a touch-sensitive screen for gesture or graphical input, keyboard, mouse, motion input, speech and so forth. Additionally, input device 222 may take in data from one or more sensors 136, discussed above. An output device 224 may also be one or more of a number of output mechanisms known to those of skill in the art. In some instances, multimodal systems enable a user to provide multiple types of input to communicate with information handling system 138. Communications interface 226 generally governs and manages the user input and system output. There is no restriction on operating on any particular hardware arrangement and therefore the basic hardware depicted may easily be substituted for improved hardware or firmware arrangements as they are developed.

As illustrated, each individual component describe above is depicted and disclosed as individual functional blocks. The functions these blocks represent may be provided through the use of either shared or dedicated hardware, including, but not limited to, hardware capable of executing software and hardware, such as a processor 202, that is purpose-built to operate as an equivalent to software executing on a general purpose processor. For example, the functions of one or more processors presented in FIG. 2 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 208 for storing software performing the operations described below, and random access memory (RAM) 210 for storing results. Very large scale integration (VLSI) hardware embodiments, as well as custom VLSI circuitry in combination with a general purpose DSP circuit, may also be provided.

The logical operations of the various methods, described below, are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. Information handling system 138 may practice all or part of the recited methods, may be a part of the recited systems, and/or may operate according to instructions in the recited tangible computer-readable storage devices. Such logical operations may be implemented as modules configured to control processor 202 to perform particular functions according to the programming of software modules 216, 218, and 220.

Figure 3:
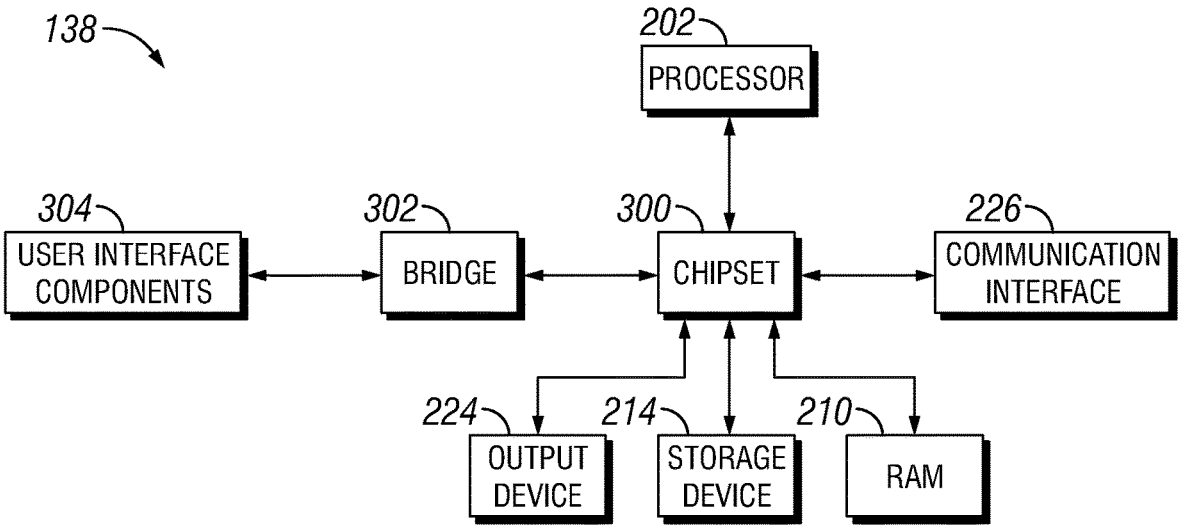
FIG. 3 is another schematic view of the information handling system.

In examples, one or more parts of the example information handling system 138, up to and including the entire information handling system 138, may be virtualized. For example, a virtual processor may be a software object that executes according to a particular instruction set, even when a physical processor of the same type as the virtual processor is unavailable. A virtualization layer or a virtual "host" may enable virtualized components of one or more different computing devices or device types by translating virtualized operations to actual operations. Ultimately however, virtualized hardware of every type is implemented or executed by some underlying physical hardware. Thus, a virtualization compute layer may operate on top of a physical compute layer. The virtualization compute layer may include one or more virtual machines, an overlay network, a hypervisor, virtual switching, and any other virtualization application FIG. 3 illustrates an example information handling system 138 having a chipset architecture that may be used in executing the described method and generating and displaying a graphical user interface (GUI). Information handling system 138 is an example of computer hardware, software, and firmware that may be used to implement the disclosed technology. Information handling system 138 may include a processor 202, representative of any number of physically and/or logically distinct resources capable of executing software, firmware, and hardware configured to perform identified computations. Processor 202 may communicate with a chipset 300 that may control input to and output from processor 202. In this example, chipset 300 outputs information to output device 224, such as a display, and may read and write information to storage device 214, which may include, for example, magnetic media, and solid state media. Chipset 300 may also read data from and write data to RAM 210. A bridge 302 for interfacing with a variety of user interface components 304 may be provided for interfacing with chipset 300. Such user interface components 304 may include a keyboard, a microphone, touch detection and processing circuitry, a pointing device, such as a mouse, and so on. In general, inputs to information handling system 138 may come from any of a variety of sources, machine generated and/or human generated.

Chipset 300 may also interface with one or more communication interfaces 226 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 202 analyzing data stored in storage device 214 or RAM 210. Further, information handling system 138 receive inputs from a user via user interface components 304 and execute appropriate functions, such as browsing functions by interpreting these inputs using processor 202.

In examples, information handling system 138 may also include tangible and/or non-transitory computer-readable storage devices for carrying or having computer-executable instructions or data structures stored thereon. Such tangible computer-readable storage devices may be any available device that may be accessed by a general purpose or special purpose computer, including the functional design of any special purpose processor as described above. By way of example, and not limitation, such tangible computer-readable devices may include RAM, ROM, EEPROM, CD-ROM or other optical disk storage, magnetic disk storage or other magnetic storage devices, or any other device which may be used to carry or store desired program code in the form of computer-executable instructions, data structures, or processor chip design. When information or instructions are provided via a network, or another communications connection (either hardwired, wireless, or combination thereof), to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices During drilling operations information handling system 138 may process different types of the real time data originated from varied sampling rates and various sources, such as diagnostics data, sensor measurements, operations data, and or the like through one or more sensors 136 disposed at any suitable location within and/or on RSS 130. (e.g., referring to FIG. 1). These measurements from one or more sensors 136 may allow for information handling system 138 to perform real-time health assessment of the rotary steerable tool.

A health assessment may be performed by processing measurements to determine if faults may be present. For example, measurements taken by sensors 136 may be processed by information handling system 138 to determine various faults through various fault detection techniques. Various fault detection techniques may include thresholds, range checks, limit check, cumulative sum, and/or the like. These fault detection techniques may be performed by information handling system 138 either disposed on RSS 130 or at the surface, as illustrated in FIG. 1.

Figure 4:
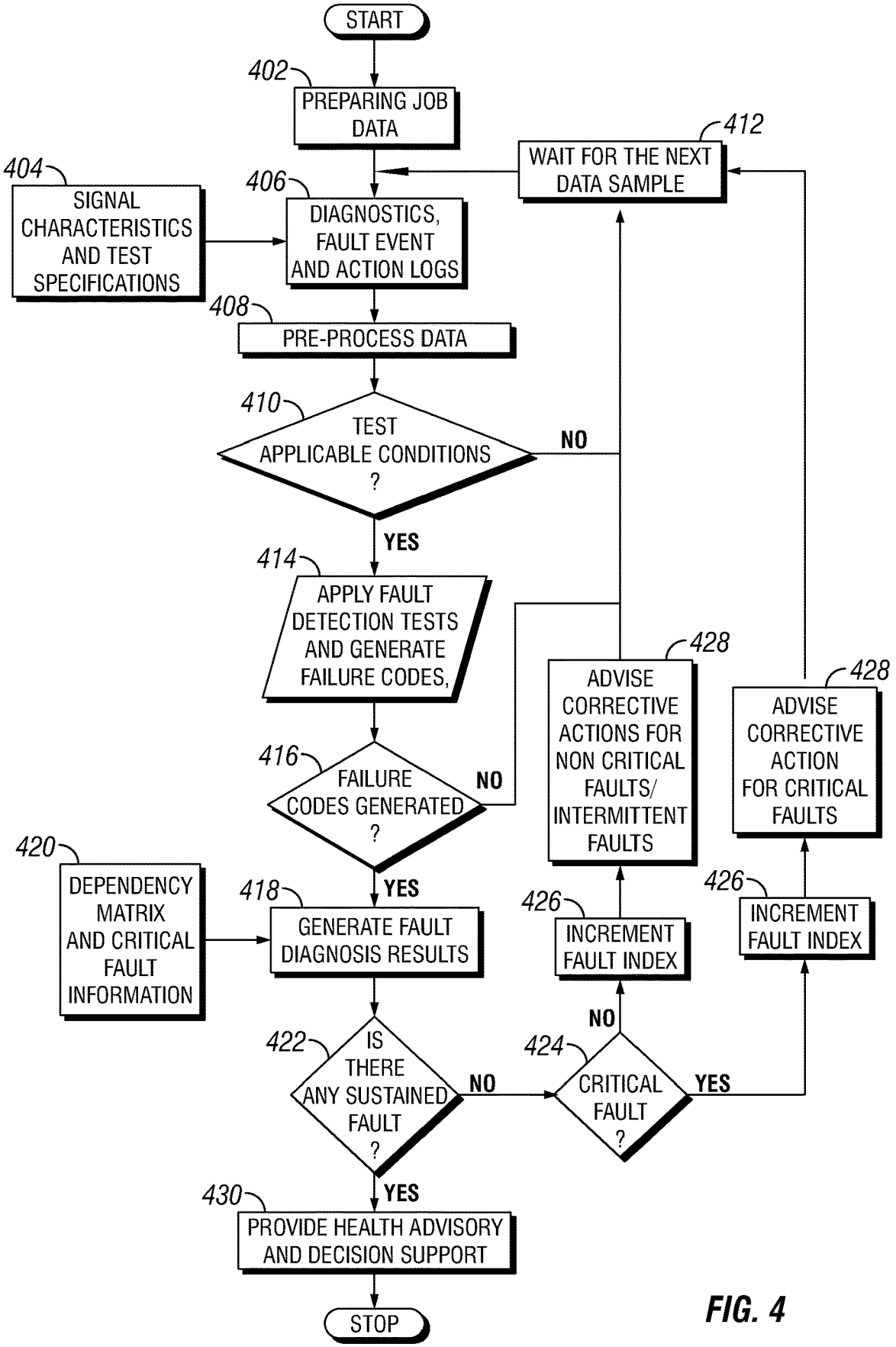
FIG. 4 is a flow chart for identifying possible faults within a rotary steerable tool.

FIG. 4 illustrates a workflow 400 for identifying possible faults within a rotary steerable tool. In examples, workflow 400 may be loaded on to information handling system 138 (e.g., referring to FIG. 1), which may allow information handling system 138 to process measurements, as described in FIGS. 2 and 3, with workflow 400. Workflow 400 may begin with forming job data in block 402. Forming job data may include collecting drilling operational data, such as drilling path, operational ranges for RSS 130 (e.g., referring to FIG. 1) and elements within RSS 130, calibration of sensors, identification of possible fault locations, and/or the like. In block 404 signal characteristics and test specifications are identified. For example, a fault detection approach is created and the criteria for various faults are defined, which may include thresholds, range checks, limit check, cumulative sum, and/or the like. Additionally, within block 404, the test and signal characteristics are populated based on one or more fault detection techniques are identified and may be based at least in part on drilling requirements and operational range of RSS 130. During downhole operations, RSS 130 may undergo constant diagnostic review in block 406. Diagnostic monitoring may include checking the operational status of the one or more sensors 136 and if one or more sensors 136 fall within identified operational range set by sensors calibration. As discussed above, the one or more sensors 136 may be accelerometers, magnetometers, gyroscopes, temperature sensors, speed sensors, position sensors, and/or the like. During diagnostic monitoring, if a sensor is not performing or functioning as calibrated a fault may be created. Each sensor may self-report a failing of the sensor to create a fault or if the sensor goes off-line, as no measurements are sent, then a fault may be created.

Additionally, the one or more sensors 136 may perform tracking measurements. During tracking measurements one or more sensors 136 be used to monitor a location and progression of RSS 130 within formation 106. If RSS 130 is not following a pre-defined plan from block 402, then a fault may be created. In examples, accelerometers, magnetometers, gyroscopes, and/or the like may be used to determine the position and location of RSS 130 within formation 106.

The one or more sensors 136 may also directly monitor mechanical operations of RSS 130. The mechanical operations of devices and parts of RSS 130 may be monitored to determine devices and parts of RSS 130 are operating correctly. Specifically, if the devices and parts of RSS 130 are operating as intended and programed. Sensors for measuring or evaluating the mechanical devices and parts of RSS 130 may be temperature sensors, speed sensors, position sensors, and/or the like.

In block 406 diagnostics are performed and a fault event log and action log are populated. The fault event log is populated during downhole operations. In example, the fault event log is initialized out at a time (ti) for each sensor 136 and the tests defined for RSS 130. As drilling operations begin, measurements may be taken by each sensor 136 at a specified sample time. Sampling time may be individual drilling operations, sensor type and other operations requirements.

In block 408 pre-processing of the measured data is performed. For example, the samples taken by each sensor 136 are processed for evaluation. Data may be combined into measurements taken by sensors 136 downhole and measurements taken at the surface. Additionally, measurements may be grouped into localized measurements, which may be focused on different parts of RSS 130, for example drill bit 122 and mechanisms utilized to move RSS 130 within a formation 106. After pre-processing, the collected measurements are sent to block 410.

In block 410 a test of applicable conditions is performed. In this block failure test are performed on the collected measurements to determine if there is a failure in any part or parts of drilling system 100 (e.g., referring to FIG. 1). For example, diagnostics data, sensor measurements, operational data, survey measurements, sensory state, drilling system 100 state, BHA 134 state, and an RSS 130 state are checked to determine if a failure has occurred in these systems or measurements. If the criteria fails, which means no failure is present, then then workflow 400 moves to block 412, in which information handling system 138 may wait for the next data sample for processing. However, if the test criteria passes, which means a failure is present, then workflow moves to block 414.

In block 414, workflow 400 applies the fault detection tests and generates failure codes. For example, if a fault is found from the fault detection test, the fault is paired with a failure code in block 414. Additionally, a failure code is generated if it fails the test. The failure code identifies where the failure is located, what the failure may be, and how critical the failure is. There are various ways to generate a failure code. For example, a threshold check or a significant statistical test. For each test, there may be one signal or combination of signals (from one or more sensors) that goes through the algorithms tailored for each test. For example, a measurement that is out of range of the identified limits and the failure test may be identified as a malfunction of sensor 136 that the measurement originates from is identified with the failure code. There may be any number of failure codes that may be generated, based at least in part on any number of failed tests.

In block 416, workflow 400 reviews the test to determine if failure codes are generated. A generated failure code is processed to determine if the one or more failure codes are generated at RSS 130 or at the surface. If the failure code is not generated from bock 414, workflow 400 move to block 412, in which information handling system 138 may wait for the next data sampling for processing. However, if a failure code is generated from RSS 130, BHA 134, sensors 136, or the like, then the failure code moves to block 418.

Block 418 generates fault diagnosis results, which are formed with information from block 420. Block 420 is a dependency matrix and critical fault information are populated. For example, the dependency matrix may be populated with critical faults or non-critical faults. The dependency matrix connects tests and failure modes (failure of a type, component, module, subsystem etc.) in RSS 130, sensors 136, or one or more performance failures. The fault criticality provides information relating a failure mode of RSS 130 to the overall criticality with various levels. This information supports the decision making in case of failures. Within the dependency matrix, failure codes may also be color coded and diagnostic information may be matched to specific failure codes. Additionally, critical and no-critical failure/function information may be matched to specific failure codes as well. The information from the dependent matrix may be combined with failure codes from block 416 in block 418.

In block 418, a fault diagnosis may be generated based on the one or more failure codes from block 416 and dependency matrix in block 420. The one or more failure codes in 416 are matched with the information from the dependency matrix in block 420. Additionally, the one or more failure codes may be organized based at least in part on time of failure, location of failure, and type of failure code generated. In examples, a distance measure-based metric for fault isolation may be combined with the dependency matrix and the one or more failure codes. For example, in a particular operation mode and tool mode, failure signatures are detected (output 1 for failed test and 0 for passed test for a total of n available tests), such signatures are matched against a dependency matrix for RSS 130. A distance measurement, D, is used as a metric to find the possible root cause of the failure of RSS 130 in real time. Information provided in block 418 may also be operational strategies that take into account the failure that created a failure code. Operational strategy may be based on the diagnostic results obtained in an interactive fashion in a dashboard system. Block 418 may also provide diagnostic advisories based on the failure signature, and intelligently tailored information from real time data and advisories to help improve situational awareness and decision making. This may allow for real-time diagnostics information of RSS 130 failure symptoms to aid RSS 130 diagnostics and repair.

Diagnostic results from block 418 may be further processed in block 422. Block 422 determines if there are any sustained faults. For example, block 422 may determine if one or more failure codes from block 418 are found in a previous time duration. To determine if a failure code has been observed before, the following equation is used:

$$F_k = L \text{ in } T \tag{1}$$

Where $F_k$ is a fault code identified in block 418 and tied to a diagnostic result in fault index k. L is minimum instances of observation for fault k. T is time duration defined for a sustained fault consideration. If the fault, $F_K$ has not been seen at least L instances before, then the fault information goes to block 424. In block 424, the fault is processed to determine if the failure code is critical. Based on expert knowledge of the system, a data-driven approach, faults are categorized as a critical fault or non-critical fault. A critical fault is defined as a fault that should be addressed immediately to guarantee the acceptable drilling performance or not permanently damage drilling equipment. A non-critical fault is defined as failures, which may be addressed by changing the tool operation in a suboptimal fashion (limp mode) and still finish a drilling operation. These faults may be additional sub-categories as operations critical and RSS health critical faults. In block 426, an increment fault index is formed or further populated with the number of critical faults or non-critical faults, which are then stored in information handling system 138 (e.g., referring to FIG. 1) to be used in block 422 during operations. If none of the faults are not critical, then diagnostic information are moved to block 428. In block 428 which advises on corrective action is given for non-critical faults, intermittent faults, and/or critical faults. The advisory and corrective actions are pre-defined for given set of fault observation, previous actions and current operating conditions and may be drawn from the dependency matrix in block 420. Workflow 400 then moves from block 428 to block 412, where information handling system 138 waits for addition data samples.

Referring back to block 422, if the one or more faults have been observed at least L times, then the one or more diagnostic information move to block 430. In block 430, a health advisory and decision support is provided. In block 420, the diagnostic information are presented to personnel as well as possible mitigation actions to address the diagnostic information. Mitigation actions may include switching to limp mode (reduced drilling capacity and operational space) when possible during drilling operations and provide diagnostic advisories to the driller to take corrective actions to reduce nonproductive time (NPT). Mitigation actions may also include when to remove RSS 130 from formation 106 (e.g., referring to FIG. 1) for repair. In examples, mitigation actions and advisories may include recommendations to reduce speed, halt operations, proceed with operations if the fault is non-critical, replace sensors, replace parts on RSS 130, and/or the like.

Personnel may be altered to the one or more failure through sound, graphics, and/or a combination of both. Additionally, recommendations may be presented to personnel on whether to downlink any special commands to make a limited use of RSS 130, continue drilling operations, halt drilling operations and removing RSS 130 from borehole 102. Thus, personnel may be alerted with real time fault diagnosis of RSS 130 using real time data, aiding situational awareness, with which personnel would actively make decisions based on each real time fault diagnosis. In another example, personnel may be altered with only selected solutions approach to the fault as information handling system 138 (e.g., referring to FIG. 1) may filter out solutions that are not likely to solve the one or more fault situations. This may improve situational awareness for personnel and provide interactive diagnostic advisories to decide on subsequent operation steps. Finally, information handling system 138 may act on behalf of personnel may make automated decisions, which may aid in fast decisions making during real time drilling operations.

In an example, during drilling operations if an active rectification of the AC voltage fails, RSS 130 may still receive sufficient voltage by passive rectification. However, personnel may perceive this as a failure and may take decisions based on the diagnostic information. Diagnostic information may include possible solutions and explanations that may guide the personnel to continue drilling. This failure may be solved when RSS 130 is removed from borehole 102 (e.g., referring to FIG. 1) as it guides them to check for problems in active rectification.

As disclosed above, the methods and systems are improvement over current technology. Specifically, disclosed is a framework for real-time diagnostics of RSS 130 using real time measurements from sensors 136 disposed within and/or on RSS 130 and BHA 134. Measurements may include real time items comprising of critical parameter measurements and fault codes. Fault codes may further populate a failure cause and effect dependency matrix. These improvements may allow for real time fault codes generated from fault detection tests executed by the downhole drilling tool during drilling operations. These fault codes from events corresponding to both fault occurrence and disappearance during downhole operations may be pulsed up to the surface for further evaluation. Implementation of diagnostics tests at the rig-site leveraging all available information and integration of such test results along with the fault test results for accurate real time health assessment of RSS 130. This may provide intelligent mitigation advisories to the driller based on automated real time diagnostics analysis.

These improvements may allow for real time fault diagnostics of the drilling tool using data-driven approach and interactive presentation of such diagnostic results to improve situational awareness that enable fast and accurate decisions. Minimize trips out of borehole 102 (e.g., referring to FIG. 1) due to RSS 130 failures by switching to limp mode when possible and provide diagnostic advisories to the driller to take corrective actions to reduce nonproductive time (NPT). Real time fault diagnostics information, health advisory, diagnostics-based plots and information on critical signals is accessible to any computer/smart device with proper authentication and network access. Such features may be useful for drilling operations and repair and Maintenance shops as it provides real time information and they can mobilize people/assets accordingly. The systems and methods may include any of the various features of the systems and methods disclosed herein, including one or more of the following statements.

Statement 1: A method comprising disposing a rotary steerable system (RSS) into a borehole. The RSS may comprise one or more sensors configured to measure a location the RSS in a formation from one or more tracking measurements and monitor a mechanical operation of the RSS. The method may further comprise identifying a failure from the one or more tracking measurements, the mechanical operation of the RSS, or the one or more sensors from a diagnostic review. Additionally, the method may further comprise flagging the failure with a failure code and reporting the failure and its mitigation actions to personnel in real time.

Statement 2. The method of statement 1, further comprising pairing the failure code and a failure mode with a dependency matrix.

Statement 3. The method of statement 2, wherein the dependency matrix is populated with one or more diagnosis and one or more advisories for the failure.

Statement 4. The method of statement 3, further comprising sending the one or more diagnosis and the one or more advisories with the failure code to the personnel for review.

Statement 5. The method of statement 4, further comprising providing an interactive diagnostic display that include the failure code, the one or more diagnosis, and the one or more advisories.

Statement 6. The method of statement 3, further comprising filtering the one or more diagnosis to one or more selected diagnosis with an information handling system.

Statement 7. The method of statement 6, further comprising sending the one or more selected diagnosis and the one or more advisories with the failure code to the personnel for review.

Statement 8. The method of statement 3, further comprising automatically altering one or more operations of the RSS based at least in part on the dependency matrix.

Statement 9. The method of statement 8, wherein the dependency matrix alters the one or more operations of the RSS based at least in part on one or more solutions in the dependency matrix.

Statement 10. The method of statement 9, further comprising alerting personnel to the failure code, the one or more diagnosis, and the one or more advisories that were implemented to alter the one or more operations of the RSS.

Statement 11. A system comprising a rotary steerable system (RSS). The RSS may comprise one or more sensors configured to measure a location the RSS in a formation from one or more tracking measurements and monitor a mechanical operation of the RSS. The system may further comprise an information handling system configured to identify a failure from the one or more tracking measurements, the mechanical operation of the RSS, or the one or more sensors from a diagnostic review, flag the failure with a failure code, and report the failure code to personnel in real time.

Statement 12. The system of statement 11, wherein the information handling system is further configured to pair the failure code and a failure mode with a dependency matrix.

Statement 13. The system of statement 12, wherein the dependency matrix is populated with one or more diagnosis and one or more advisories for the failure.

Statement 14. The system of statement 13, wherein the information handling system is further configured to send the one or more diagnosis and the one or more advisories with the failure code to the personnel for review.

Statement 15. The system of statement 14, wherein the information handling system is further configured to provide an interactive diagnostic display that include the failure code, the one or more diagnosis, and the one or more advisories.

Statement 16. The system of statement 13, wherein the information handling system is further configured to automatically alter one or more operations of the RSS based at least in part on the dependency matrix.

Statement 17. The system of statement 16, wherein the dependency matrix alters the one or more operations of the RSS based at least in part on one or more solutions in the dependency matrix.

Statement 18. The system of statement 17, wherein the information handling system is further configured to alert personnel to the failure code, the one or more diagnosis, and the one or more solutions that were implemented to alter the one or more operations of the RSS.

Statement 19. The system of statement 11, wherein the information handling system is further configured to filter one or more diagnosis to one or more selected diagnosis.

Statement 20. The system of statement 19, wherein the information handling system is further configured to send the one or more selected diagnosis and one or more advisories with the failure code to the personnel for review. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

disposing a rotary steerable system (RSS) into a borehole, wherein the RSS comprises:

one or more sensors configured to measure a location of the RSS in a formation from one or more tracking measurements and monitor a mechanical operation of the RSS; and identifying a failure from the mechanical operation of the RSS or the one or more sensors from a diagnostic review, wherein the failure represents the failure of a device or part of a device disposed on the RSS;

flagging the failure with a failure code;

pairing the failure code and a failure mode with a dependency matrix, wherein a distance measure-based metric for fault isolation is combined with the dependency matrix and the failure code; and reporting the failure and its mitigation actions to personnel in real time.

2. The method of claim 1, wherein the dependency matrix is populated with one or more diagnosis and one or more advisories for the failure.

3. The method of claim 2, further comprising sending the one or more diagnosis and the one or more advisories with the failure code to the personnel for review.

4. The method of claim 3, further comprising providing an interactive diagnostic display that include the failure code, the one or more diagnosis, and the one or more advisories.

5. The method of claim 2, further comprising filtering the one or more diagnosis to one or more selected diagnosis with an information handling system.

6. The method of claim 5, further comprising sending the one or more selected diagnosis and the one or more advisories with the failure code to the personnel for review.

7. The method of claim 2, further comprising automatically altering the mechanical operation of the RSS based at least in part on the dependency matrix.

8. The method of claim 7, wherein the dependency matrix alters the mechanical operation of the RSS based at least in part on one or more solutions in the dependency matrix.

9. The method of claim 8, further comprising alerting the personnel to the failure code, the one or more diagnosis, and the one or more advisories that were implemented to alter the mechanical operation of the RSS.

10. A system comprising:

a rotary steerable system (RSS) comprising:

one or more sensors configured to measure a location the RSS in a formation from one or more tracking measurements and monitor a mechanical operation of the RSS; and an information handling system configured to:

identify a failure from the mechanical operation of the RSS or the one or more sensors from a diagnostic review, wherein the failure represents the failure of a device or part of a device disposed on the RSS;

flag the failure with a failure code;

pair the failure code and a failure mode with a dependency matrix, wherein a distance measure-based metric for fault isolation is combined with the dependency matrix and the failure code; and report the failure code to personnel in real time.

11. The system of claim 10, wherein the dependency matrix is populated with one or more diagnosis and one or more advisories for the failure.

12. The system of claim 11, wherein the information handling system is further configured to send the one or more diagnosis and the one or more advisories with the failure code to the personnel for review.

13. The system of claim 12, wherein the information handling system is further configured to provide an interactive diagnostic display that include the failure code, the one or more diagnosis, and the one or more advisories.

14. The system of claim 11, wherein the information handling system is further configured to automatically alter the mechanical operation of the RSS based at least in part on the dependency matrix.

15. The system of claim 14, wherein the dependency matrix alters the mechanical operation of the RSS based at least in part on one or more solutions in the dependency matrix.

16. The system of claim 15, wherein the information handling system is further configured to alert the personnel to the failure code, the one or more diagnosis, and the one or more solutions that were implemented to alter the mechanical operation of the RSS.

17. The system of claim 10, wherein the information handling system is further configured to filter one or more diagnosis to one or more selected diagnosis.

18. The system of claim 17, wherein the information handling system is further configured to send the one or more selected diagnosis and one or more advisories with the failure code to the personnel for review.

* * * * *